US005941095A

United States Patent [19]

Gistau-Baguer

[11] Patent Number: 5,941,095

[45] Date of Patent: Aug. 24, 1999

[54] PROCESS FOR THE COMPRESSION OF A GAS AT LOW TEMPERATURE AND LOW PRESSURE, AND CORRESPONDING COMPRESSION LINE AND REFRIGERATION INSTALLATION

[75] Inventor: Guy Gistau-Baguer, Biviers, France

[73] Assignee: L'Air Liquide, Societe Anonyme Pour L'Etude et L'Exploitation des Procedes Georges Claude, Paris Cedex, France

[21] Appl. No.: 08/862,375

[22] Filed: May 23, 1997

[30] Foreign Application Priority Data

Feb. 24, 1997 [FR] France ..... 97 02173

[51] Int. Cl.[6] ..... F25J 1/00

[52] U.S. Cl. ..... 62/613; 62/619

[58] Field of Search ..... 62/613, 619

[56] References Cited

U.S. PATENT DOCUMENTS 3,416,324 12/1968 Swearingen ..... 62/619
3,954,430 5/1976 Curtis et al. ..... 62/619
4,566,885 1/1986 Haak ..... 62/613
4,758,257 7/1988 Gates et al. ..... 62/613

*Primary Examiner*—Ronald C. Capossela
*Attorney, Agent, or Firm*—Young & Thompson

[57] ABSTRACT

A process for the compression of helium at low temperature and low pressure, and a compression line and refrigeration unit corresponding thereto. A plurality of centrifugal compressors ($C_1$ to $C_4$) in series are so dimensioned as to supply nominal compression loads $\tau_{1N}, \ldots \tau_{nN}$ for same nominal mass flow rate $D_N$. A (n+1)th centrifugal compressor ($C_5$) is dimensioned for a nominal compression load substantially equal to $\tau_{1N}$ for a decreased mass flow rate $D_D$ is less than $D_N$ of the precompressed gas at a pressure $P_0$ multiplied by $\tau_{2N} \times \ldots \times \tau_{nN}$. This extra compressor is placed in series upstream of the n centrifugal compressors. The (n+1)th compressor is adjusted such that the compressors of rows 2 to n ensure substantially constant compression loads that are equal respectively to $\tau_{2N}, \ldots, \tau_{nN}$, and the compressors of rows 1 and (n+1) ensure compression loads $\tau_1$ and $\tau_{n+}$such that substantially $\tau_1 \times \tau_{n+1} = \tau_{1N}$. The foreseen use is for the refrigeration of elements of superconductors.

12 Claims, 2 Drawing Sheets

PROCESS FOR THE COMPRESSION OF A GAS AT LOW TEMPERATURE AND LOW PRESSURE, AND CORRESPONDING COMPRESSION LINE AND REFRIGERATION INSTALLATION

This application corresponds to French application 97 02173 of Feb. 24, 1997, the disclosure of which is incorporated herein by reference.

The present invention relates to a process for compression of a gas initially at low temperature and low pressure $P_0$ in a compression line comprising n centrifugal compressors mounted in series and so dimensioned to supply respectively and successively the nominal compression loads $\tau_{1N}, \ldots, \tau_{nN}$ for same nominal mass flow $D_N$ of said gas, in which process the operation of the end centrifugal compressors is regulated to ensure a total nominal compression load $\tau_N=\tau_{1N}\times \ldots \times\tau_{nN}$ for a mass flow D of gas substantially equal to $D_N$.

The invention is applicable for example to the cooling of superconductive elements of particle accelerators.

The pressures in question are absolute pressures.

The cooling of the superconductor elements of particle accelerators requires the use of fluid at equilibrium at low temperature and low pressure, particularly helium, whose vaporization ensures the necessary heat transfer.

The refrigeration installations used in these applications comprise liquefaction units capable, starting with gaseous helium at atmospheric pressure and at ambient temperature, of supplying liquid helium in equilibrium with its gas phase at temperatures of the order of 2° K. and at pressures of the order of 30 mbars.

The power dissipated by the superconductive elements vaporizes the liquid helium, which must be recompressed to be reintroduced into the liquefaction unit, whose inlet pressure is fixed at a value of the order of atmospheric pressure. The role of the compression line is to control the inlet pressure and hence the temperature of the liquid helium.

At present, only the compression lines with centrifugal compressors in series permit compressing, to the desired compression load, a flow rate sufficient to obtain medium or strong refrigeration power. The centrifugal compressors are thus dimensioned to ensure the desired compression load for the nominal mass flow of gaseous helium vaporized by the superconductive elements operating at full capacity.

During down times, or for operation of the superconductive elements at reduced levels, the refrigeration needs and hence the mass flow of gaseous helium vaporized and introduced into the compression line, decreases. This decrease of mass flow can give rise to loss of synchronism of the compressors, which must ensure a constant compression load.

The solution adopted until now consists in maintaining artificially the mass flow rate of gaseous helium, by injecting electric power into the liquid helium bath. The expenditures of energy during down time or reduced operation are thus greater than those actually necessary for the cooling of the superconductive elements.

The invention has for its object to provide a solution to the problem mentioned above, by providing a process for the compression of gas at low temperature and low pressure to compress, with a substantially constant compression load, a nominal mass flow and at least one decreased mass flow of gas.

To this end, the invention has for its object a process for the compression of a gas initially at low temperature and low pressure $P_0$ in a compression line comprising n centrifugal compressors mounted in series and dimensioned to provide respectively and successively the nominal compression loads $\tau_{1N}, \ldots, \tau_{nN}$ for a same nominal mass flow $D_N$ of said gas, in which process the operation of the n centrifugal compressors is regulated to ensure a total compression load $\tau_n=\tau_{1N}\times \ldots \times\tau_{nN}$ for a nominal mass flow D of gas substantially equal to $D_N$, characterized in that there is added a (n+1)th centrifugal compressor of reduced size, in series and downstream of the n centrifugal compressors, so dimensioned as to ensure a nominal compression load substantially equal to $\tau_{1N}$ for a decreased mass flow rate $D_D<D_N$ of said gas precompressed to the pressure $P_0\times\tau_{2N}\times \ldots \times\tau_{nN}$, and, for at least one mass flow of the gas comprised between $D_D$ and $D_N$ of gas, there is adjusted the operation of the (n+1) compressors such that the compressors of rows 2 to n ensure compression loads that are substantially constant and equal respectively to $\tau_{2N}, \ldots, \tau_{nN}$, and such that the compressors of rows 1 and (n+1) ensure compression loads respectively $\tau_1$ and $\tau_{n+1}$ such that it is substantially true that $\tau_1\times\tau_{n+1}=\tau_{1N}$.

According to particular embodiments, the process could comprise one or several of the following characteristics:

- the operation of the (n+1) compressors is adjusted such that the compressors of rows 2 to n ensure substantially constant compression loads that are equal respectively to $\tau_{2N}, \ldots, \tau_{nN}$, and such that the compressors of rows 1 and (n+1) ensure compression loads respectively $\tau_1$ and $\tau_{n+1}$ such that substantially $\tau_1\times\tau_{n+1}=\tau_{1n}$, for at least a mass flow rate D of said gas substantially equal to $D_D$;
- the operation of the (n+1) compressors is so adjusted that the compressors of rows 2 to n ensure substantially constant compression loads that are equal respectively to $\tau_{2N}, \ldots, \tau_{nN}$, and such that the compressors of rows 1 and (n+1) ensure compression loads respectively $\tau_1$ and $\tau_{n+1}$ such that substantially $\tau_1\times\tau_{n+1}=\tau_{1n}$, for mass flow rates varying continuously between at least $D_D$ and $D_N$;
- the operation of the compressors of rows 1 to n is so adjusted that the reduced flow rate at the intake of the following compressor will be substantially constant and equal to its reduced nominal intake flow rate, for said value or values of the mass flow rate.

The invention also has for its object a compression line for practicing the process defined above, comprising on the one hand n centrifugal compressors mounted in series and dimensioned to ensure respectively and successively nominal compression loads $\tau_{1N}, \ldots, \tau_{nN}$ for a same nominal mass flow rate, $D_N$ of said gas, and on the other hand pilot means for the n compressors such that the compression line ensures a total compression load $\tau_n=\tau_{1N}\times \ldots \times\tau_{nN}$ for a mass flow rate D of gas substantially equal to $D_N$, characterized in that the compression line comprises a (n+1)th centrifugal compressor of reduced size, disposed in series and downstream of the n first centrifugal compressors, so dimensioned as to ensure a nominal compression load substantially equal to $\tau_{1N}$ for a decreased mass flow $D_D<D_N$ of said gas precompressed substantially to the pressure $P_0\times\tau_{2N},\times \ldots \times\tau_{nN}$, and pilot means for the (n+1)th centrifugal compressor, and in that the pilot means of the (n+1) centrifugal compressors are such that the compressors of rows 2 to n ensure substantially constant compression loads equal respectively to $\tau_{2N}, \ldots, \tau_{nN}$, and such that the compressors of rows 1 and (n+1) ensure respectively compression loads $\tau_1$ and $\tau_{n+1}$ such that substantially $\tau_1\times\tau_{n+1}=\tau_{1N}$ for at least a mass flow rate D of said gas comprised between $D_D$ and $D_N$.

According to particular embodiments, the compression line could comprise one or several of the following characteristics:

the pilot means of the (n+1) centrifugal compressors are so adapted that the compressors of rows 2 to n will ensure a substantially constant compression load equal respectively to $\tau_{2N}$, . . . , $\tau_{nN}$, and such that the compressors of rows 1 and (n+1) will ensure respectively compression loads $\tau_1$ and $\tau_{n+1}$ such that $\tau_1 \times \tau_{n+1} = \tau_{1N}$ for at least a mass flow D of said gas substantially equal to $D_D$;

the pilot means of the (n+1) centrifugal compressors are so adapted that the compressors of rows 2 to n ensure substantially constant compression loads that are equal respectively to $\tau_{2N}$, . . . , $\tau_{nN}$, and such that the compressors of rows 1 and (n+1) ensure compression loads $\tau_1$ and τn+1 such that substantially $\tau_1 \times \tau_{n+1} = \tau_{1N}$ for mass flow rates D of said gas bearing continuously between at least $D_D$ and $D_N$;

the pilot means for each of the n first compressors are adapted to ensure, at least for said flow rate or said flow rates, compression loads such that the reduced flow rate at the inlet of the following compressor is substantially constant and equal to its reduced nominal inlet flow rate, and in that the pilot means of the (n+1)th compressor are adapted so as to ensure a total compression load in the compression line that will be substantially constant and equal to the product $\tau_{1N} \times \ldots \times \tau_{nN}$;

the pilot means of each of the n first compressors comprise a pilot unit connected to pressure detectors and inlet temperature detectors of the following compressor and to a mass flow rate detector of the gas circulating in the compression line, and each pilot unit comprises means for computing and storing data and is adapted to calculate, from signals received by the detectors, the reduced inlet flow rate of the following compressor, to compare this reduced calculated flow rate with the reduced nominal inlet flow rate of this following compressor, and to control the speed of rotation of the compressor of the detector that it pilots, so as to annul the result of the comparison;

the delivery of this compression line is at a substantially constant and predetermined pressure, and the pilot means of the (n+1)th compressor comprise a pilot unit provided with means for calculating and storing data, connected to an inlet pressure detector of the compression line, and adapted to compare this measured pressure to the nominal inlet pressure corresponding to the total nominal desired compression load $\tau_N$ and to control the speed of rotation of the (n+1)th compressor so as to annul the result of the comparison.

Finally, the invention has for its object an installation for refrigeration by vaporization of a liquefied gas at low pressure and low temperature, particularly helium, comprising a storage containing the diphase fluid at low temperature and low pressure, a liquefaction unit for said gas associated with expansion means for said liquified gas, a supply line for diphase fluid at low temperature and low pressure connecting the liquefaction unit to the storage, and a compression line for the gaseous phase connecting the storage to the liquefaction unit, characterized in that the compression line is a compression line as defined above.

The invention will be better understood from a reading of the description which follows, given solely by way of example, and with respect to the accompanying drawings, in which.

Figure 1:
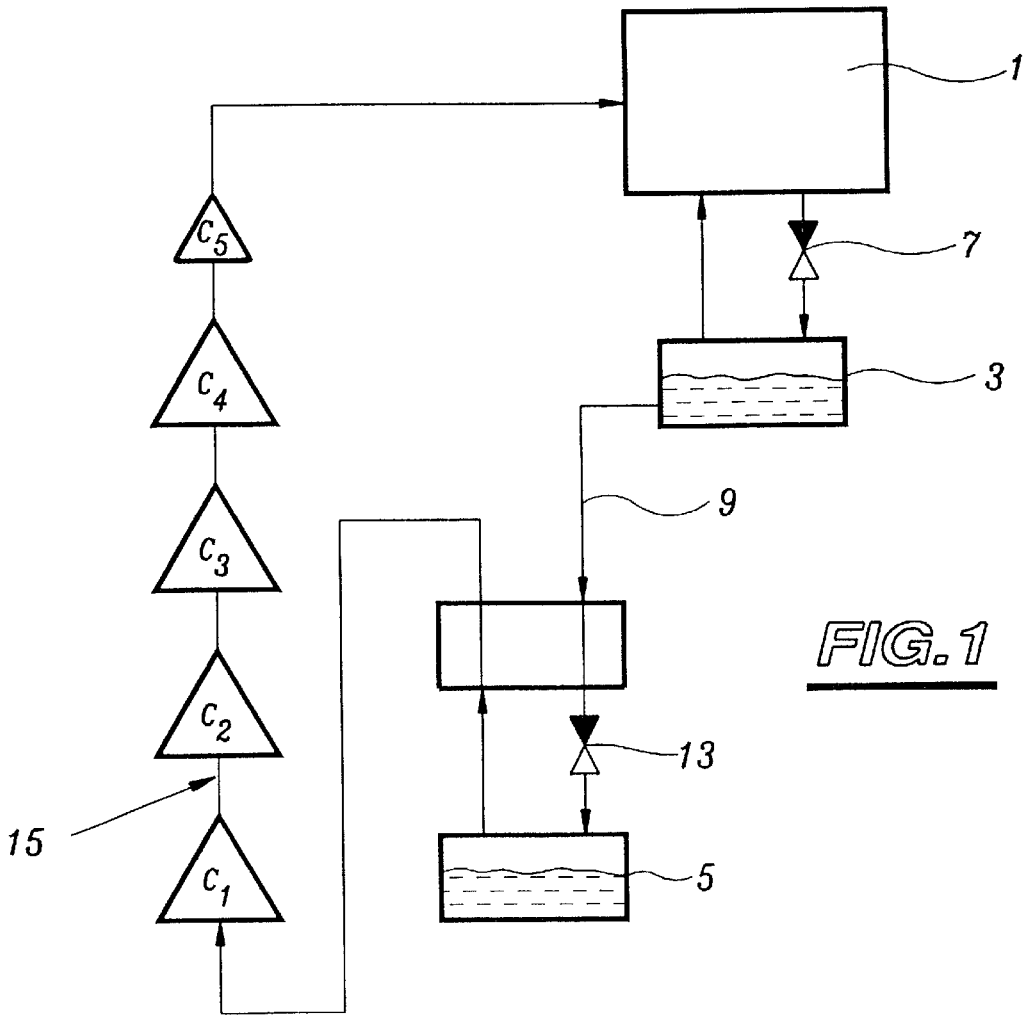
FIG. 1 is a schematic view showing a cooling installation according to the invention.

FIG. 1 shows an installation for refrigeration by liquid helium, used for example for cooling superconductor elements of particle accelerators. This installation comprises a unit 1 for the liquefaction of helium, comprising compressors, heat exchangers and expansion means, not shown, a first capacity 3 for storing liquid helium in equilibrium with its gaseous phase, and a second capacity 5 for storage of liquid helium in equilibrium with its gaseous phase, which ensure heat exchange with the refrigerated element.

The unit 1 for liquefaction of helium, delivers after expansion, for example, in an expansion valve 7, liquid helium in equilibrium with its gaseous phase in the first capacity 3. In operation, the helium is then at a temperature of about 4.4° K. and a pressure of about 1.2 bar.

The liquid of the first capacity 3 is extracted through a line 9, cooled by a heat exchanger 11, then expanded in an expansion valve 13 before being introduced in equilibrium with its gaseous phase into the second capacity 5. In operation, the helium must be, in this capacity, at a temperature of about 2° K. and a pressure of about 31.3 mbar (or hPa).

The gaseous sky of the second capacity 5 is returned, after heating, in countercurrent in the exchanger 11, to a compression line 15 which returns the gaseous helium to the liquefaction unit 1.

The back pressure of the compression line is imposed by the liquefaction unit 1 at a value of about 1.15 bar. The compression line permits, in operation, lowering the equilibrium pressure and hence the equilibrium temperature of the helium in the second capacity 5 to the desired value.

Such a refrigeration installation is described in French patent 2.679.635 and U.S. Pat. No. 5,499,505.

The compression line 15 comprises five centrifugal compressors $C_1$, $C_2$, $C_3$, $C_4$ and $C_5$ mounted in series. The four first compressors are so dimensioned as to constitute a conventional compression line. Thus, they are dimensioned to ensure, for a nominal mass flow rate of gaseous helium $D_N$= 236.8 g/s, successive nominal compression loads respectively equal to $\tau_{1N}$=2.57, $\tau_{2N}$=2.9, $\tau_{3N}$=2.71, and $\tau_{4N}$=2.03. The pilot means (not shown), such as those described in U.S. Pat. No. 5,499,505, are provided such that the compressors $C_1$, $C_2$, $C_3$ and $C_4$ will ensure a total nominal compression load $\tau_N$=41, permitting obtaining helium at around 2° K. in the second capacity 5.

For easier description of the operation of the compressors, the following parameters will be used:

the "reduced" flow rate of a compressor:

$$Y = \frac{D \times \sqrt{T}}{P}$$

the "reduced" speed of a compressor:

$$n = \frac{N}{\sqrt{T}}$$

in which D is the mass flow rate passing through the compressor, T the inlet temperature of the compressor, P the inlet pressure of the compressor and N the speed of rotation of the compressor, the "reduced-reduced" flow rate of a compressor:

$$X = \frac{Y}{Y_N}$$

and the "reduced-reduced" speed of a compressor:

$$NU = \frac{n}{n_N}$$

in which $Y_N$ is the "reduced" nominal flow rate of the compressor, which is to say under conditions of operation corresponding to those of its dimensioning, and $n_N$ is the "reduced" nominal speed of the compressor, which is to say under conditions of operation corresponding to those of its dimensioning.

Figure 2:
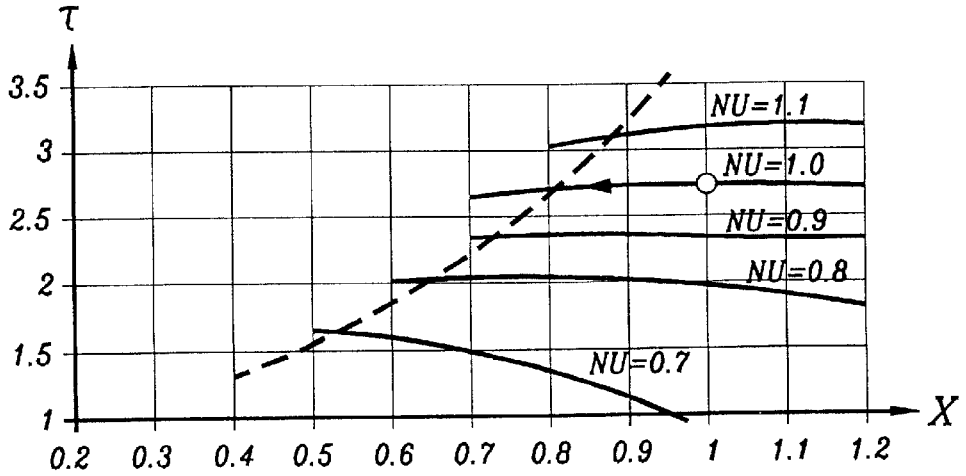
FIG. 2 is a graph representing the field of compression of a centrifugal compressor.

The graph of FIG. 2 shows the field of compression of a centrifugal compression in a "reduced-reduced"/compression load flow plane.

The curve of loss of synchronism in the rotor blades, shown in broken lines, separates the field of compression of the compressor into a stable region of operation to the right of the desynchronization curve and the region of unstable operation to the left of the desynchronization curve. Thanks to the use of "reduced-reduced" variables, this curve permits on the one hand studying the operation of a compressor under conditions other than those defined for the nominal operation, and on the other hand to compare the operation of different compressors, which do not necessarily have identical fields. The point of operation corresponding to the dimensioning of the compressor (which is to say for X=1 and NU=1) is materialized by a circle.

In the prior art, the decrease of the mass flow of gaseous helium in the compression line gives rise to decrease of the "reduced-reduced" flow rate of each compressor, which continue to work at constant speed. The points of operation of the compressors are displaced along the length of the constant speed line NU=1 toward the dissynchronization curve. The lines of compression of the prior art are therefore not stable until the time at which a point of operation of a compressor encounters the dissynchronization curve.

The compression line according to the invention comprises, in addition to the n compressors ensuring for a mass flow rate of gas equal to $D_N$ a total compression load substantially equal to $\tau_N$, an additional compressor of reduced size $C_5$.

This compressor is so dimensioned as to compress a decreased mass flow $D_D$=120 g/s of gaseous helium, pre-compressed to a pressure of 448 mb, at a nominal compression load of $\tau_{5N}=2.57=\tau_{1N}$.

Figure 3:
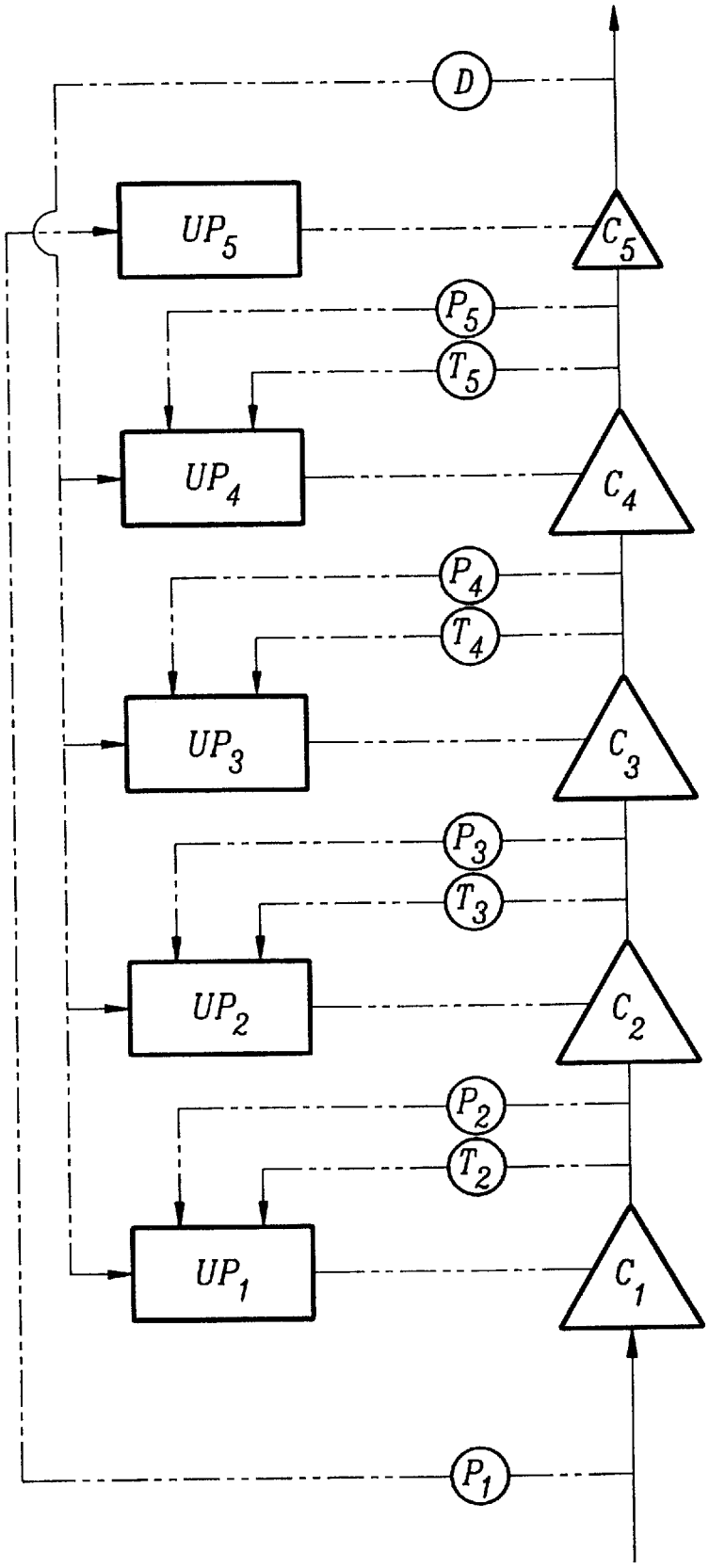
FIG. 3 is a schematic view showing more particularly the pilot means for the compression line of the refrigeration installation of FIG. 1.

FIG. 3 shows more particularly the pilot means suitable for the invention. The pilot means comprise five electronic pilot units $UP_1$, $UP_2$, $UP_3$, $UP_4$ and $UP_5$ connected respectively to the compressors $C_1$, $C_2$, $C_3$, $C_4$ and $C_5$. The pilot unit $UP_1$ is connected to pressure detectors $P_2$ and temperature detectors $T_2$ at the inlet of the compressor $C_2$. Similarly, the pilot units $UP_2$, $UP_3$ and $UP_4$ are connected to inlet pressure and temperature detectors, respectively, of the compressors $C_3$, $C_4$ and $C_5$. A detector of the mass flow rate D of the gas circulating in the compression line 15 is connected to each of the pilot units of the units $UP_1$, $UP_2$, $UP_3$ and $UP_4$.

Pilot units $UP_1$–$UP_5$ each comprise computing means and data storage means.

A detector of the inlet pressure $P_1$ of the compressor $C_1$ is connected to the pilot unit $UP_5$.

The mode of piloting the compressors $C_1$, $C_2$, $C_3$ and $C_4$ is identical and will be described solely for the compressor $C_1$. The pilot unit $UP_1$ computes, from signals that it receives from the different detectors to which it is connected, the "reduced-reduced" flow rate $X_2$ of the compressor $C_2$. If $X_2$ is less than 1, it controls the decrease of the speed of rotation of the compressor $C_1$, so as to increase the ratio $\sqrt{T_2}/P_2$. If $X_2$ is greater than 1, it controls the increase of the speed of rotation of the compressor $C_2$. In each case, $X_2$ is thus brought back to 1.

The piloting mode of the compressor $C_5$ is as follows. The pilot unit $UP_5$ compares $P_1$, which is to say the equilibrium pressure of the liquid helium in the capacity 5, with the value of the desired equilibrium pressure. If $P_1$ is grater than the desired value, therefore if the total compression load of the compression line is too weak, the pilot unit $UP_5$ directs an increase of the speed of rotation of the compressor $C_5$. Conversely, for a pressure $P_1$ less than the desired equilibrium pressure, $UP_5$ commands a decrease in the speed of rotation of the compressor $C_5$.

The starting of the installation and its stabilization for a mass flow rate D of gas substantially equal to $D_N$ takes place as described in U.S. Pat. No. 5,499,505 mentioned above, with compressors $C_1$, $C_2$, $C_3$ and $C_4$, the compressor $C_5$ letting pass the gaseous helium compressed by the four first compressors without loss of load, if desired by causing $C_5$ for this purpose to turn at low speed.

Table 1 shows the different parameters of operation of the compressors of the nominal regime, which is to say when the compression line is stabilized at a mass flow rate of gaseous helium and a total compression load substantially equal respectively to $D_N$ and $\tau_N$.

TABLE 1

| | τ (–) | P (bar) | T (K) | D (g/s) | X (–) | N (Hz) | NU (–) |
|---|---|---|---|---|---|---|---|
| Intake $C_1$ | 2.57 | 0.0280 | 3.32 | 236.8 | 1.000 | 116 | 1.000 |
| Intake $C_2$ | 2.90 | 0.0720 | 5.72 | 236.8 | 1.000 | 216 | 1.000 |
| Intake $C_3$ | 2.71 | 0.2090 | 10.41 | 236.5 | 1.000 | 409 | 1.000 |
| Intake $C_4$ | 2.03 | 0.5670 | 18.53 | 236.8 | 1.000 | 565 | 1.000 |
| Intake $C_5$ | 1.00 | 1.1540 | 28.00 | 236.8 | 1.000 | 0 | 0.000 |
| Output $C_5$ | | 1.1540 | 28.00 | 236.8 | | | |

For compressors $C_1$, $C_2$, $C_3$ and $C_4$, X=1 and Nu=1. These compressors operate under their nominal conditions.

The operation of the invention is the following. When cooling needs decrease from the condition shown in Table 1, the mass flow rate of gaseous helium in the compression line 15 decreases. $X_1$ decreases therefore, but $\tau_1$ remains substantially constant by virtue of the attraction of same speed NU=1. $P_2$ is thus substantially constant and $X_2$ decreases. $UP_1$ therefore controls the diminution of the speed of rotation of the compressor $C_1$, giving rise to an increase of $\sqrt{T_2}/P_2$ until $X_2$ will once more be equal to 1.

Similarly, the pilot units $UP_2$, $UP_3$, $UP_4$ modify the speeds of rotation of the compressors $C_2$, $C_3$ and $C_4$ such that $X_3$, $X_4$ and $X_5$ remain substantially equal to 1.

For a stable value of mass flow rate D of gas, comprised between $D_N$ and $D_D$, the speed of rotation of the compressor $C_1$ is therefore decreased to ensure that $X_2$=1, but the "reduced-reduced" speeds of the compressors $C_2$, $C_3$ and $C_4$ are maintained at unity because the "reduced-reduced" flow rates of the compressors $C_2$ to $C_5$ are substantially equal to 1. The compressors $C_2$, $C_3$ and $C_4$ therefore operate under their nominal conditions and their "reduced-reduced" speed of rotation equals 1.

The compressors $C_2$, $C_3$ and $C_4$ each supply compression loads for which they have been dimensioned. On the other hand, the compression load of $C_1$ is less than its nominal compression load $\tau_{1N}$ because its speed of rotation has decreased. The pilot unit $UP_5$ has therefore ordered the rotation of the compressor $C_5$ to compensate this decrease of $\tau_1$ such that substantially $\tau_1 \times \tau_5 = \tau_{1N}$, such that the total compression load in the compression line therefore remains substantially equal to $\tau_N$.

TABLE 2

| | τ (–) | P (bar) | T (K) | D (g/s) | X (–) | N (Hz) | NU (–) |
|---|---|---|---|---|---|---|---|
| Intake $C_1$ | 1.636 | 0.0280 | 3.35 | 170.0 | 0.721 | 79 | 0.680 |
| Intake $C_2$ | 2.900 | 0.0458 | 4.49 | 170.0 | 1.000 | 191 | 1.000 |
| Intake $C_3$ | 2.713 | 0.1328 | 8.17 | 170.0 | 1.000 | 362 | 1.000 |
| Intake $C_4$ | 2.035 | 0.3603 | 14.53 | 170.0 | 1.000 | 500 | 1.000 |
| Intake $C_5$ | 1.574 | 0.7334 | 21.96 | 170.0 | 1.000 | 719 | 0.780 |
| Output $C_5$ | | 1.1540 | 28.77 | 170.0 | | | |

TABLE 3

| | τ (–) | P (bar) | T (K) | D (g/s) | X (–) | N (Hz) | NU (–) |
|---|---|---|---|---|---|---|---|
| Intake $C_1$ | 1.001 | 0.0280 | 3.37 | 120.0 | 0.511 | 0 | 0 |
| Intake $C_2$ | 2.900 | 0.0280 | 3.38 | 120.0 | 1.000 | 166 | 1.000 |
| Intake $C_3$ | 2.713 | 0.0813 | 6.13 | 120.0 | 1.000 | 314 | 1.000 |
| Intake $C_4$ | 2.035 | 0.2206 | 10.91 | 120.0 | 1.000 | 434 | 1.000 |
| Intake $C_5$ | 2.571 | 0.4489 | 16.48 | 120.0 | 1.000 | 799 | 1.000 |
| Output $C_5$ | | 1.1540 | 28.27 | 120.0 | | | |

Tables 2 and 3 shows respectively the operating parameters of the compressors for mass flow rates D=170 g/s and $D=D_D$=120 g/s of gas.

For the mass flow rate $D=D_D$, the compressor $C_1$ is stopped, or maintained in rotation at low speed to annul any loss of pressure by passing through it, and lets pass without pressure drop the gaseous helium, the compressor $C_5$ compressing, at a compression load substantially equal to $\tau_{1N}$, the liquid helium precompressed to 440 mbars by the compressors $C_2$, $C_3$ and $C_4$.

Conversely, if the cooling requirement increases, therefore if D increases from a mass flow rate of gas $D<D_N$, the tendency of $X_2$ to increase is controlled by the pilot unit $UP_1$ which orders an increase in the speed of rotation of the compressor $C_1$. Similarly, the pilot units $UP_1$, $UP_2$, $UP_3$ and $UP_4$ maintain the values of $X_2$, $X_3$, $X_4$ and $X_5$ at unity. The speed of rotation of the compressor $C_1$ increases, $\tau_1$ also increases. $UP_5$ orders the decrease of the speed of rotation of the compressor $C_5$ to ensure a total compression load that is substantially constant and equal to $\tau_N$.

The invention therefore permits ensuring a substantially constant and equal compression load at a desired value for variable flow rates in a continuous manner between at least $D_D$ and $D_N$. Moreover, the illustrated installation works in a stable fashion because the compressors $C_2$, $C_3$, $C_4$ and $C_5$ work with values of "reduced-reduced" variables adjacent unity and hence substantially under conditions for which they have been designed. Moreover, the piloting of $C_1$ with $X_1$ and $\tau_1$ decreasing or increasing simultaneously ensures that the compressor operates always within its range of stability.

For mass flow rates D less than $D_D$ or greater than $D_N$, the conventional piloting such as described in U.S. Pat. No. 5,499,505 permits working within the limits of the fields of stability of the compressors.

What is claimed is:

1. In a process for the compression of a gas initially at low temperature and low pressure $P_0$ in a compression line comprising n centrifugal compressors mounted in series and so dimensioned as to supply respectively and successively nominal compression loads $\tau_{1n}, \ldots, \tau_{nN}$ for a same nominal mass flow rate $D_N$ of said gas, in which process the operation of the n centrifugal compressors is adjusted to ensure a total nominal compression load $\tau_N = \tau_{1N} \times \ldots \times \tau_{nN}$ for a gas mass flow rate D substantially equal to $D_N$; the improvement which comprises adding a (n+1)th centrifugal compressor of reduced size, in series with and downstream of the n centrifugal compressors, the added compressor being so dimensioned as to ensure a nominal compression load substantially equal to $\tau_{1N}$ for a decreased mass flow rate $D_D$ less than $D_N$ of said gas precompressed substantially to the pressure $P_0 \times \tau_{2N} \times \ldots \times \tau_{nN}$, and, for at least one mass flow rate of the gas comprised between $D_D$ and $D_N$, adjusting the operation of the (n+1) compressor such that the compressors of rows 2 to n ensure substantially constant compression loads equal respectively to $\tau_{2N}, \ldots, \tau_{nN}$ and such that the compressors of rows 1 and (n+1) ensure respectively compression loads $\tau_1$ and $\tau_{n+1}$ such that substantially $\tau_1 \times \tau_{n+1} = \tau_{1N}$.

2. A process as claimed in claim 1, further comprising adjusting the operation of the (n+1) compressor such that the compressors of rows 2 to n ensure substantially constant compression loads equal respectively to $\tau_{2N}, \ldots, \tau_{nN}$ and such that the compressors of rows 1 and (n+1) ensure compression loads respectively $\tau_1$ and $\tau_{n+1}$ such that substantially $\tau_1 \times \tau_{n+1} = \tau_{1N}$, for at least a mass flow rate D of said gas substantially equal to $D_D$.

3. Process according to claim 1, further comprising adjusting the operation of the (n+1) compressor such that the compressors of rows 2 to n ensure substantially constant compression loads equal respectively to $\tau_{2N}, \ldots, \tau_{nN}$ and such that the compressors of rows 1 and (n+1) ensure compression loads respectively $\tau_1$ and $\tau_{n+1}$ such that substantially $\tau_1 \times \tau_{n+1} = \tau_{1N}$, for mass flow rates D of said gas varying continuously between at least $D_D$ and $D_N$.

4. Process according to claim 1, further comprising adjusting the operation of the compressors of rows 1 to n such that the reduced flow rate at the inlet of the following compressor will be substantially constant and equal to its nominal inlet reduced flow rate, for said value of mass flow.

5. A process according to claim 1, wherein said gas is helium.

6. In a compression line for compressing a gas initially at low temperature and low pressure, comprising n centrifugal compressors mounted in series and so dimensioned to ensure respectively and successively nominal compression loads $\tau_{1N}, \ldots, \tau_{nN}$ for a same nominal mass flow rate $D_N$ of said gas, and pilot means for the n compressors such that the compression line provides a total nominal compression load $\tau_{1N} = \tau_{1N} \times \ldots \times \tau_{nN}$ for a mass flow D of gas substantially equal to $D_N$; the improvement in which the compression line comprises a (n+1)th centrifugal compressor of reduced size, disposed in series and downstream of the n first centrifugal compressors, said compressor of reduced size being so dimensioned as to ensure a nominal compression load substantially equal to $\tau_{1N}$ for a decreased mass flow $D_D<D_N$ of said gas precompressed substantially to the pressure $P_0 \times \tau_{2N} \times \ldots \times \tau_{nN}$, and means for piloting the (n+1)th centrifugal compressor, the pilot means of the (n+1)th centrifugal compressor being so adapted that the compressors of rows 2 and n will provide substantially constant compression loads and equal respectively to $\tau_{2N}, \ldots, \tau_{nN}$, and such that the compressors of rows 1 and (n+1) will ensure respectively compression loads $\tau_1$ and $\tau_{n+1}$ such that substantially $\tau_1 \times \tau_{n+1} = \tau_{1N}$ for at least a mass flow rate D of said gas comprised between $D_D$ and $D_N$.

7. A compression line according to claim 6, wherein the pilot means for the (n+1) centrifugal compressor are adapted such that the compressors of rows 2 to n ensure substantially constant compression loads equal respectively to $\tau_{2N}, \ldots, \tau_{nN}$, and such that the compressors of rows 1 and (n+1) ensure respectively compression loads $\tau_1$ and $\tau_{n+1}$ such that substantially $\tau_1 \times \tau_{n+1} = \tau_{1N}$, for at least a mass flow D of said gas substantially equal to $D_D$.

8. A compression line according to claim 6, wherein the pilot means for the (n+1) centrifugal compressor are adapted such that the compressors of rows 2 to n ensure substantially constant compression loads equal respectively to $\tau_{2N}, \ldots, \tau_{nN}$, and such that the compressors of rows 1 and (n+1) ensure compression loads of $\tau_1$ and $\tau_{n+1}$ such that substantially $\tau_1 \times \tau_{n+1} = \tau_{1N}$, for mass flow rates D of said gas varying continuously between at least $D_D$ and $D_N$.

9. A compression line according to claim 6, wherein the pilot means for each of the n first compressors are adapted to ensure, at least for said flow rate, compression loads such that the reduced flow rate at the inlet of the following compressor is substantially constant and equal to its reduced nominal inlet flow rate, and the pilot means for the (n+1)th compressor are adapted to ensure a total compression load in the compression line that is substantially constant and equal to the product $\tau_{1N} \times \ldots \times \tau_{nN}$.

10. A compression line according to claim 6, wherein the pilot means for each of the n first compressors comprise a pilot unit connected to pressure detectors and temperature detectors at the intake of the following compressor and to a detector of the mass flow of the gas circulating in the compression line, each pilot unit comprising means for computing and storing data and being adapted to calculate, from signals received from the detectors, the reduced inlet flow rate of the following compressor, to compare this reduced calculated flow rate with the reduced nominal inlet flow rate of this following compressor, and to control the speed of rotation of the compressor that it pilots such as to annul the result of the comparison.

11. A compression line according to claim 6, wherein the back pressure of said compression line is a substantially constant and predetermined pressure, the pilot means of the (n+1)th compressor comprising a pilot unit provided with means for calculating and storing data, connected to a pressure detector for the inlet of the compression line, and adapted to compare this measured pressure to the nominal inlet pressure corresponding to the desired total nominal compression load $\tau_N$ and to control the speed of rotation of the (n+1)th compressor so as to annul the result of the comparison.

12. In an installation for refrigeration by vaporization of a liquefied gas at low pressure and low temperature, comprising a capacity containing a diphase fluid at low temperature and low pressure, a unit for liquefaction of said gas associated with means for expanding said liquefied gas, a supply line of two phase liquid at low temperature and low pressure connecting the liquefaction unit to a storage, and a line for compression of the gaseous phase connecting the storage to the liquefaction unit; the improvement wherein the compression line is a compression line according to claim 6.

* * * * *